US009070246B2

(12) United States Patent
Fiden et al.

(10) Patent No.: US 9,070,246 B2
(45) Date of Patent: Jun. 30, 2015

(54) WAGERING GAME WITH CHARACTER LEARNING

(75) Inventors: Daniel P. Fiden, Chicago, IL (US); Lisa M. Helfer, Chicago, IL (US); Matthew J. Ward, Northbrook, IL (US)

(73) Assignee: WMS GAMING, INC., Waukegan, IL (US)

( * ) Notice: Subject to any disclaimer, the term of this patent is extended or adjusted under 35 U.S.C. 154(b) by 1614 days.

(21) Appl. No.: 11/630,355

(22) PCT Filed: Jun. 30, 2005

(86) PCT No.: PCT/US2005/023098

§ 371 (c)(1),
(2), (4) Date: Dec. 21, 2006

(87) PCT Pub. No.: WO2006/004832

PCT Pub. Date: Jan. 12, 2006

(65) Prior Publication Data

US 2008/0293473 A1 Nov. 27, 2008

Related U.S. Application Data

(60) Provisional application No. 60/584,713, filed on Jun. 30, 2004.

(51) Int. Cl.
*A63F 9/00* (2006.01)
*G07F 17/32* (2006.01)

(52) U.S. Cl.
CPC ..... *G07F 17/32* (2013.01); *G07F 17/3227* (2013.01); *G07F 17/3239* (2013.01)

(58) Field of Classification Search
CPC .. G07F 17/32; G07F 17/3227; G07F 17/3239
USPC ..... 463/20–22, 40–42, 1, 6, 16–18, 24, 463/30–33
See application file for complete search history.

(56) References Cited

U.S. PATENT DOCUMENTS 4,752,068 A 6/1988 Endo
5,575,474 A 11/1996 Rossides (Continued)

FOREIGN PATENT DOCUMENTS

WO WO9929381 6/1999
WO WO 2005082480 A1 9/2005

(Continued)

OTHER PUBLICATIONS

International Search Report—PCT/US05/23098 dated Nov. 8, 2005 (4 pages).

*Primary Examiner* — Ronald Laneau
*Assistant Examiner* — Ross Williams
(74) *Attorney, Agent, or Firm* — Nixon Peabody LLP

(57) ABSTRACT

Wagering game terminal and method of operating same are disclosed where the player characters or avatars learn from the experiences of previous games. Thus, the player characters or avatars in effect remember the paths they have taken and/or the choices they have selected previously. This learning or remembrance may occur across multiple games and may be manifested by visual and/or audio reminders, including removal of the previously taken paths/choices. Other indicators such as audio or text messages may also be used. The player characters or avatars may also refuse or be reluctant to repeat a particular path/choice. In this way, the player may retain the benefits of his earlier efforts, thereby increasing player excitement and enjoyment.

25 Claims, 9 Drawing Sheets

(56) References Cited

U.S. PATENT DOCUMENTS

| | | | | |
|---|---|---|---|---|
| 5,609,525 | A | 3/1997 | Ohno et al. | |
| 5,833,537 | A | 11/1998 | Barrie | |
| 5,957,775 | A | 9/1999 | Cherry | |
| 6,004,211 | A | 12/1999 | Brenner et al. | |
| 6,012,045 | A | 1/2000 | Barzilai | 705/37 |
| 6,012,983 | A | 1/2000 | Walker et al. | |
| 6,015,344 | A | 1/2000 | Kelly et al. | 463/16 |
| 6,024,643 | A * | 2/2000 | Begis | 463/42 |
| 6,068,553 | A | 5/2000 | Parker | 463/27 |
| 6,077,163 | A | 6/2000 | Walker et al. | |
| 6,106,395 | A * | 8/2000 | Begis | 463/23 |
| 6,113,098 | A | 9/2000 | Adams | |
| 6,165,071 | A | 12/2000 | Weiss | |
| 6,234,896 | B1 | 5/2001 | Walker et al. | |
| 6,254,481 | B1 | 7/2001 | Jaffe | 463/20 |
| 6,273,820 | B1 | 8/2001 | Haste | |
| 6,290,602 | B1 * | 9/2001 | Kawano | 463/23 |
| 6,302,790 | B1 | 10/2001 | Brossard | 463/20 |
| 6,311,976 | B1 | 11/2001 | Yoseloff et al. | 273/138 |
| 6,319,127 | B1 | 11/2001 | Walker et al. | |
| 6,364,765 | B1 | 4/2002 | Walker et al. | |
| 6,364,766 | B1 | 4/2002 | Anderson et al. | 463/16 |
| 6,365,765 | B1 | 4/2002 | Baldwin et al. | |
| 6,431,983 | B2 | 8/2002 | Acres | |
| 6,485,367 | B1 * | 11/2002 | Joshi | 463/13 |
| 6,506,117 | B2 | 1/2003 | DeMar | 463/20 |
| 6,506,118 | B1 | 1/2003 | Baerlocher et al. | 463/25 |
| 6,561,811 | B2 * | 5/2003 | Rapoza et al. | 434/236 |
| 6,572,471 | B1 * | 6/2003 | Bennett | 463/16 |
| 6,663,489 | B2 * | 12/2003 | Baerlocher | 463/20 |
| 6,722,981 | B2 | 4/2004 | Kaminkow | 463/20 |
| 6,722,985 | B2 | 4/2004 | Criss-Puszkiewicz et al. | 463/29 |
| 6,745,236 | B1 * | 6/2004 | Hawkins et al. | 709/218 |
| 6,758,757 | B2 | 7/2004 | Luciano et al. | |
| 6,776,713 | B2 | 8/2004 | Gauselmann | |
| 6,780,111 | B2 | 8/2004 | Cannon et al. | 463/25 |
| 6,800,027 | B2 | 10/2004 | Giobbi et al. | |
| 6,811,486 | B1 | 11/2004 | Luciano et al. | |
| 6,923,721 | B2 | 8/2005 | Luciano et al. | |
| 6,979,267 | B2 * | 12/2005 | Leen et al. | 463/42 |
| 7,182,690 | B2 | 2/2007 | Giobbi et al. | 463/24 |
| 7,544,129 | B2 * | 6/2009 | Baerlocher | 463/9 |
| 2001/0024971 | A1 | 9/2001 | Brossard | 463/30 |
| 2002/0028708 | A1 | 3/2002 | Busch et al. | 463/42 |
| 2002/0039919 | A1 | 4/2002 | Joshi et al. | 463/20 |
| 2002/0077173 | A1 | 6/2002 | Luciano, Jr. et al. | 463/23 |
| 2002/0077174 | A1 | 6/2002 | Luciano et al. | |
| 2002/0093136 | A1 | 7/2002 | Moody | |
| 2002/0094871 | A1 * | 7/2002 | Luciano et al. | 463/43 |
| 2002/0107065 | A1 | 8/2002 | Rowe | |
| 2002/0151349 | A1 | 10/2002 | Joshi | 463/20 |
| 2002/0169016 | A1 * | 11/2002 | Tarantino | 463/16 |
| 2002/0196342 | A1 | 12/2002 | Walker et al. | 348/157 |
| 2003/0013515 | A1 | 1/2003 | Rowe et al. | |
| 2003/0013531 | A1 | 1/2003 | Rowe et al. | |
| 2003/0036422 | A1 | 2/2003 | Baerlocher et al. | 463/20 |
| 2003/0036427 | A1 | 2/2003 | Brandstetter et al. | |
| 2003/0064794 | A1 * | 4/2003 | Mead et al. | 463/25 |
| 2003/0069057 | A1 * | 4/2003 | DeFrees-Parrott | 463/16 |
| 2003/0078101 | A1 | 4/2003 | Schneider et al. | |
| 2003/0100362 | A1 | 5/2003 | Horniak et al. | |
| 2003/0104860 | A1 * | 6/2003 | Cannon et al. | 463/25 |
| 2003/0106769 | A1 | 6/2003 | Weiss | 463/21 |
| 2003/0114219 | A1 | 6/2003 | McClintic | |
| 2003/0119579 | A1 | 6/2003 | Walker et al. | 463/20 |
| 2003/0157979 | A1 | 8/2003 | Cannon et al. | |
| 2003/0195024 | A1 | 10/2003 | Slattery | 463/9 |
| 2003/0211881 | A1 | 11/2003 | Walker et al. | 463/20 |
| 2004/0053680 | A1 | 3/2004 | Schultz | 463/20 |
| 2004/0091848 | A1 * | 5/2004 | Nemitz | 434/365 |
| 2004/0142742 | A1 | 7/2004 | Schneider et al. | |
| 2004/0209662 | A1 | 10/2004 | Wadleigh | 463/16 |
| 2004/0235547 | A1 * | 11/2004 | Vancura | 463/9 |
| 2004/0242297 | A1 * | 12/2004 | Walker et al. | 463/13 |
| 2005/0003886 | A1 | 1/2005 | Englman et al. | 463/25 |
| 2005/0159207 | A1 | 7/2005 | Thomas | 463/20 |
| 2006/0068893 | A1 | 3/2006 | Jaffe et al. | 463/20 |
| 2006/0079316 | A1 | 4/2006 | Flemming et al. | 463/25 |
| 2006/0079317 | A1 | 4/2006 | Flemming et al. | 463/20 |
| 2006/0084495 | A1 | 4/2006 | Jaffe et al. | 463/20 |
| 2006/0084496 | A1 | 4/2006 | Jaffe et al. | 463/20 |
| 2006/0089194 | A1 | 4/2006 | Joshi et al. | 463/25 |
| 2007/0254734 | A1 | 11/2007 | Gilmore et al. | 463/20 |
| 2007/0259706 | A1 | 11/2007 | Anderson et al. | 463/16 |
| 2007/0259713 | A1 | 11/2007 | Fiden et al. | 463/25 |
| 2007/0265060 | A1 | 11/2007 | Hornik et al. | 463/20 |
| 2007/0298856 | A1 | 12/2007 | Gilmore et al. | 463/16 |
| 2008/0113770 | A1 | 5/2008 | Gelber et al. | 463/25 |

FOREIGN PATENT DOCUMENTS

| | | | | |
|---|---|---|---|---|
| WO | WO 2006002241 | A2 | 1/2006 | |
| WO | WO 2006004831 | A2 | 1/2006 | |
| WO | WO 2006004832 | A2 | 1/2006 | |
| WO | WO 2006005073 | A2 | 1/2006 | |
| WO | WO 2006017036 | A1 | 2/2006 | |
| WO | WO 2006017067 | A1 | 2/2006 | |
| WO | WO 2006017068 | A1 | 2/2006 | |
| WO | WO 2006020811 | A2 | 2/2006 | |
| WO | WO 2006026250 | A2 | 3/2006 | |
| WO | WO 2006044252 | A2 | 4/2006 | |
| WO | WO 2007/103054 | A2 | 9/2007 | G06F 19/00 |
| WO | WO 2008/048634 | A2 | 4/2008 | A63F 13/06 |

* cited by examiner

WAGERING GAME WITH CHARACTER LEARNING

CROSS-REFERENCE TO RELATED APPLICATIONS

This application is a U.S. national phase of International Application No. PCT/US2005/023098, filed Jun. 30, 2005, which claims the benefit of priority from U.S. Provisional Application No. 60/584,713, filed Jun. 30, 2004, both of which are incorporated by reference.

FIELD OF THE INVENTION

The present invention relates generally to wagering game terminals and, more particularly, to wagering game terminals where the player characters or avatars learn from the experiences of previous games.

BACKGROUND OF THE INVENTION

Wagering game terminals, such as slot machines, video poker machines, and the like, have been a cornerstone of the gaming industry for several years. The popularity of such wagering game terminals among players generally depends on the perceived likelihood of winning money at the terminal and the intrinsic entertainment value of the terminal relative to other available gaming options. Where the available gaming options include a number of competing terminals and the expectation of winning each terminal is roughly the same (or believed to be the same), players are likely to be attracted to the more entertaining and exciting of the terminals.

Consequently, wagering game terminal operators strive to employ the most entertaining and exciting terminals available because such terminals attract frequent play and, hence, increase profitability for the operators. Thus, in the highly competitive wagering game terminal industry, there is a continuing need to develop new types of games, or improvements to existing games, that will enhance the entertainment value and excitement associated with the games.

One concept that has been successfully employed in existing wagering game terminals to enhance player entertainment is the use of progressive games. In the gaming industry, a "progressive" game involves collecting coin-in data from participating gaming device(s) (e.g., slot machines), contributing a percentage of that coin-in data to a progressive jackpot amount, and awarding that jackpot amount to a player upon the occurrence of a certain jackpot-won event. A jackpot-won event typically occurs when a "progressive winning position" is achieved at a participating gaming device. If the gaming device is a slot machine, a progressive winning position may, for example, correspond to alignment of progressive jackpot reel symbols along a certain payline. The initial progressive jackpot is a predetermined minimum amount. That jackpot amount, however, progressively increases as players continue to play the gaming machine without winning the jackpot. Further, when several gaming machines are linked together such that several players at several gaming machines compete for the same jackpot, the jackpot progressively increases at a much faster rate, which leads to further player excitement.

Another concept that has been employed is that of a secondary or "bonus" game which may be played in conjunction with a "basic" game. The bonus game may include any type of game, either similar to or entirely different from the basic game, and is typically initiated by the occurrence of certain pre-selected events or outcomes of the basic game. Examples of the types of bonus games may include adventure games, guessing games, games of chance, and the like. Such a bonus game has been found to produce a significantly higher level of player excitement than the basic game alone because it provides an additional chance to play, which increases the player's overall expectation of winning.

In current wagering game terminals, whether in a basic game or bonus game, once a player leaves a gaming session, he has to start from the beginning in the next gaming session. Typically, upon termination of play, the player is awarded the balance of any credits, but also loses any unused or unredeemed game assets that he may have accumulated. Further, any selections the player may have made, for example, any paths he may have taken or options he may have chosen during the game, are reset so that there are no indications of where he has been or what he has done.

To take an example, some bonus games may involve an adventure where the player is presented with a plurality of doors from which he may choose. One of the doors leads to a grand prize, while the other doors lead to lesser prizes or no prizes. If the player chooses the wrong door the first time around, he still may guess the correct door in subsequent gaming sessions. However, the bonus games are usually randomly awarded based on the outcome of the basic game and it may be some time before he has a chance to play the bonus game again. As a result, the player may have difficulty remembering which door goes where and may wind up repeating his previous selections. This can lead to increased player frustration and possibly cause the player to become discouraged or lose interest in the game.

Thus, there is a need for wagering game terminals that allow players to benefit from their previous experiences playing at the wagering game terminals. In particular, there is a need for wagering game terminals where the player characters or avatars learn from the previous gaming sessions.

SUMMARY OF THE INVENTION

The present invention is directed to a wagering game terminal and method for operating same where the player characters or avatars learn from the experiences of previous games. Thus, the player characters or avatars in effect remember the paths they have taken and/or the choices they have selected previously. This learning or remembrance may occur across multiple games and may be manifested by visual and/or audio reminders, including removal of the previously taken paths/choices. Other indicators such as audio beeps or text messages may also be used. The player characters or avatars may also refuse or be reluctant to repeat a particular path/choice. In this way, the player may retain the benefits of his earlier efforts, thereby increasing player excitement and enjoyment.

In general, in one aspect, the invention is directed to a wagering game terminal. The wagering game terminal comprises a wager input for accepting a wager at the wagering game terminal, the wager initiating a current gaming session in which an outcome is randomly selected from a plurality of outcomes. The wagering game terminal further comprises a display for displaying an avatar representing a player in the current gaming session, the player making one or more game selections during the current gaming session using the avatar. The avatar is stored upon conclusion of the current gaming session, including information regarding the game selections made using the avatar, and a previously stored avatar is restored in a subsequent gaming session along with information regarding game selections previously made using the previously stored avatar.

In general, in another aspect, the invention is directed to a method of operating a wagering game terminal. The method comprises the steps of accepting a wager input at the wagering game, the wager input initiating a current gaming session in which an outcome is randomly selected from a plurality of outcomes, and displaying an avatar representing a player in the current gaming session, the player making one or more game selections during the current gaming session using the avatar. The method comprises the steps of storing the avatar upon conclusion of the current gaming session, including the game selections made using the avatar, and restoring a previously stored avatar in a subsequent gaming session along with game selections previously made using the previously stored avatar.

In general, in yet another aspect, the invention is directed to a wagering game system. The wagering game system comprises a network server, and a wagering game terminal connected to the network server for playing a wagering game in which an outcome is randomly selected from a plurality of outcomes, the plurality of outcomes including at least one special event outcome that results in a special event game in which a player may chose an option from a plurality of options using a avatar. The network server is configured to save information regarding the avatar and the game selections made using the avatar upon conclusion of the special event game and to restore the avatar and the game selections made using the avatar in a subsequent special event game.

In general, in still another aspect, the invention is directed to a method of operating a wagering game terminal that is configured to randomly select an outcome from a plurality of outcomes. The method comprises the steps of representing a player of a game at the wagering game terminal using an avatar, and presenting the player with a plurality of game options, each game option having a randomly assigned award. The method further comprises the steps of allowing the player to select at least one game option from the plurality of game options using the avatar, and awarding the randomly assigned award to the player upon selection of a respective game option. Information regarding the game selection made using the avatar is stored when the player leaves the game, and the game selection information is made available to the player through the avatar in a subsequent game.

In general, in yet another aspect, the invention is directed to a method of representing a player in a wagering game terminal. The method comprises the steps of presenting the player with a plurality of avatars from which the player may choose and conducting a game on the wagering game terminal with the avatar representing the player, the game having an outcome selected from a plurality of outcomes. The method further comprises allowing the player to select at least one game selection from a plurality of game selections using the avatar, the at least one game selection having an effect on the outcome of the game, and storing information regarding the at least one game selection made using the avatar for subsequent retrieval when the player leaves the game.

The above summary of the present invention is not intended to represent each embodiment or every aspect of the present invention. The detailed description and figures will describe many of the embodiments and aspects of the present invention.

BRIEF DESCRIPTION OF THE DRAWINGS

The foregoing and other advantages of the invention will become apparent upon reading the following detailed description and upon reference to the drawings.

Figure 1:
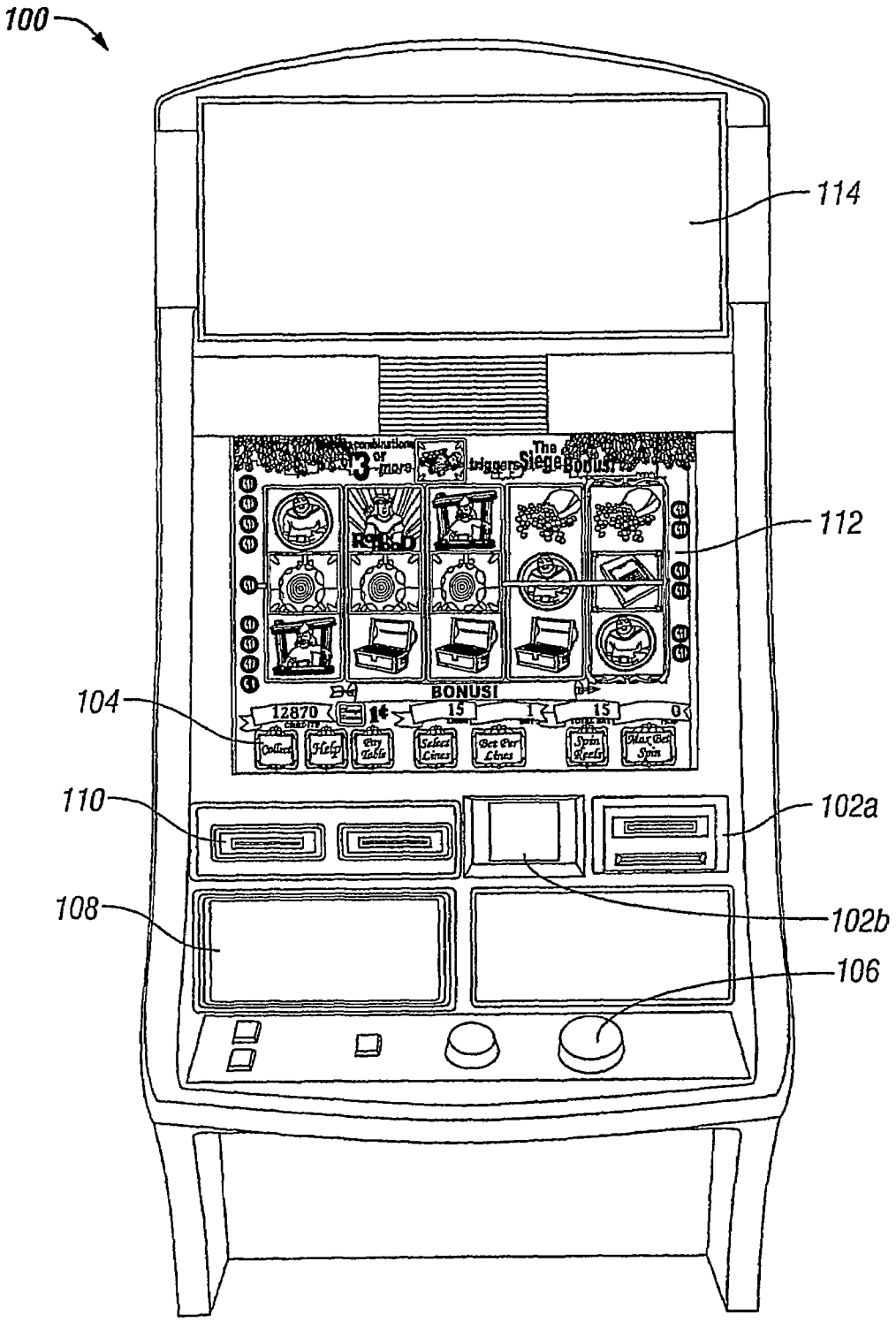
FIG. 1 illustrates a wagering game terminal having retainable game assets according to one embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

As mentioned above, embodiments of the invention provide a wagering game terminal and method for operating same where player characters or avatars "learn" from their previous experiences. Such an arrangement allows the players to avoid the hazards, pitfalls, and dead ends that they may have encountered previously and helps them to more quickly reach their main goal.

FIG. 1 shows a perspective view of an exemplary wagering game terminal 100 according to embodiments of the invention. The wagering game terminal 100 may be operated as a stand-alone terminal, or it may be connected to a network of wagering game terminals. Further, the wagering game terminal 100 may be any type of wagering game terminal and may have varying structures and methods of operation. For example, the wagering game terminal 100 may be a mechanical wagering game terminal configured to play mechanical slots, or it may be an electromechanical or electrical wagering game terminal configured to play a video casino game, such as blackjack, slots, keno, poker, etc. In the example shown, the wagering game terminal 100 is a video slot machine.

As shown, the wagering game terminal 100 includes input devices, such as a wager acceptor 102 (shown as a card wager acceptor 102*a* and a cash wager acceptor 102*b*), a touch screen 104, a push-button panel 106, a payout mechanism 108, and an information reader 110. The wagering game terminal 100 further includes a main display 112 for displaying information about the basic wagering game and, in some embodiments, a secondary display 114 for displaying a pay table and/or game-related information or other entertainment features. While these typical components found in the wagering game terminal 100 are described briefly below, it should be understood that numerous other elements may exist and may be used in any number of combinations to create variation of the wagering game terminal 100.

The wager acceptors 102*a* and 102*b* may be provided in many forms, individually or in combination. For example, the cash wager acceptor 102*a* may include a coin slot acceptor or a note acceptor to input value to the wagering game terminal 100. The card wager acceptor 102*b* may include a card-reading device for reading a card that has a recorded monetary value with which it is associated. The card wager acceptor 102*b* may also receive a card that authorizes access to a central account that can transfer money to the wagering game terminal 100.

The payout mechanism 108 performs the reverse function of the wager acceptors 102*a* and 102*b*. For example, the payout mechanism 108 may include a coin dispenser or a note dispenser to dispense money or tokens from the wagering game terminal 100. The payout mechanism 108 may also be adapted to receive a card that authorizes the wagering game terminal 100 to transfer credits from the wagering game terminal 100 to a central account.

The push button panel 106 is typically offered, in addition to the touch screen 104, to provide players with an option on making their game selections. Alternatively, the push button panel 106 may facilitate player input needed for certain aspects of operating the game, while the touch screen 104 facilitates player input needed for other aspects of operating the game.

The outcome of the basic wagering game is displayed to the player on the main display 112. The main display 112 may take a variety of forms, including a cathode ray tube (CRT), a high resolution LCD, a plasma display, LED, or any other type of video display suitable for use in the wagering game terminal 100. As shown here, the main display 112 also includes the touch screen 104 overlaying the entire display (or a portion thereof) to allow players to make game-related selections. Alternatively, the wagering game terminal 100 may include a number of mechanical reels that display the game outcome.

In some embodiments, the information reader 110 is a card reader that allows for identification of a player by reading a card with information indicating they player's identity. Currently, identification is used by casinos for rewarding certain players with complimentary services or special offers. For example, a player may be enrolled in the gaming establishment's players' club and may be awarded certain complimentary services as that player collects points in his or her player-tracking account. The player inserts his or her card into the player-identification card reader 110, which allows the casino's computers to register that player's wagering at the wagering game terminal 100. Then, the wagering game terminal 100 may use the secondary display 114 for providing the player with information about his or her account or other player-specific information. Also, in some embodiments, the information reader 110 may be used to restore assets that the player achieved during a previous gaming session and had saved.

Figure 2:
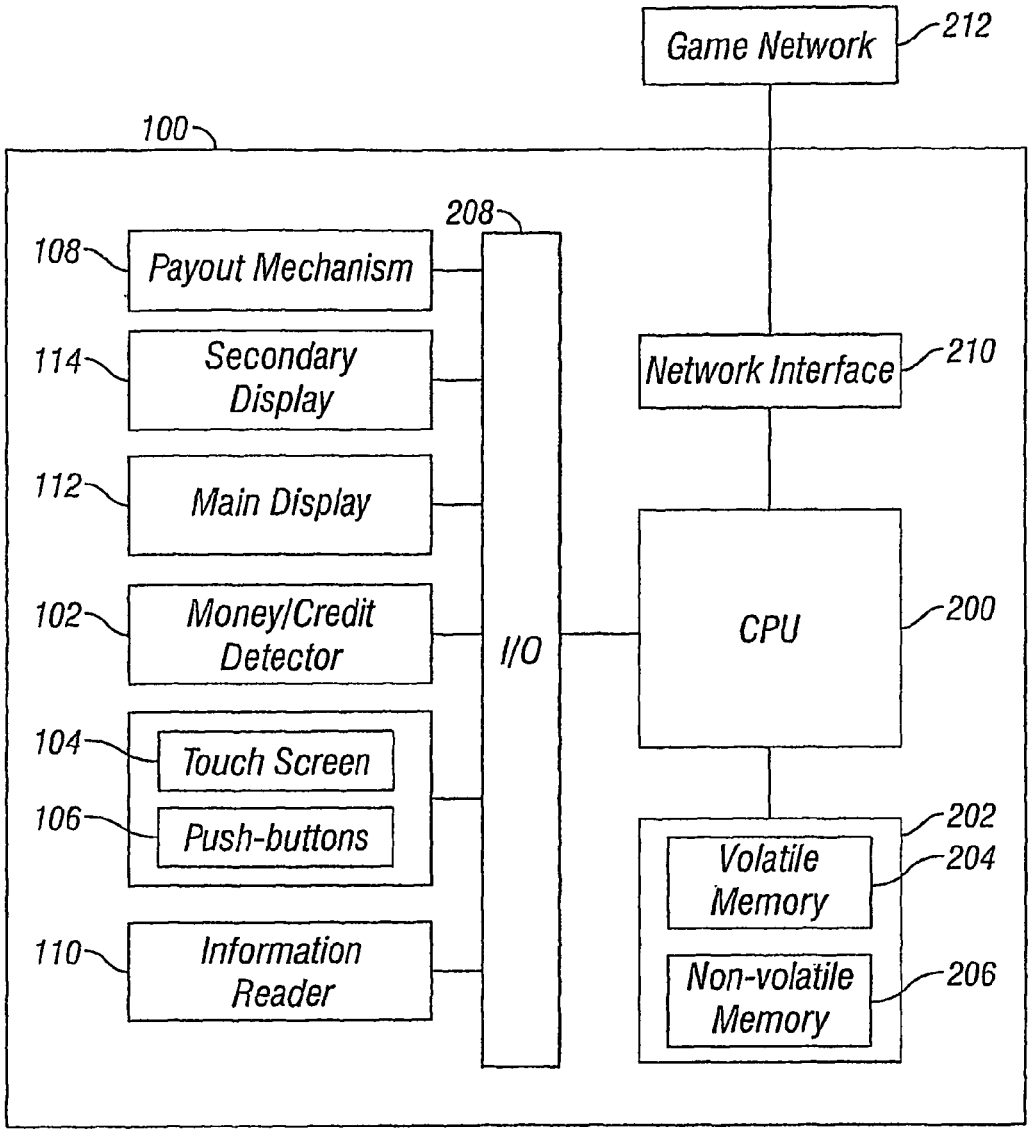
FIG. 2 illustrates the wagering game terminal of FIG. 1 in more detail.

As shown in FIG. 2, the various components of the wagering game terminal 100 are controlled by a central processing unit (CPU) 200, such as one or more microprocessors or microcontrollers. To provide the gaming functions, the CPU 200 executes a game program that generates a randomly selected game outcome. The CPU 200 is also coupled to or includes a local memory 202. The local memory 202 may be in the form of one or more volatile memories 204 (e.g., a random-access memory (RAM)) and one or more non-volatile memories 206 (e.g., an EEPROM).

Communication between the peripheral components of the wagering game terminal 100 and the CPU 200 is controlled by the CPU 200 through input/output (I/O) circuits 208. The CPU 200 also communicates with external systems via a network interface unit 210. Although the I/O circuit 208 and network interface unit 210 are shown here as individual components, it should be appreciated that both of these units may include a number of different types of components.

Figure 3:
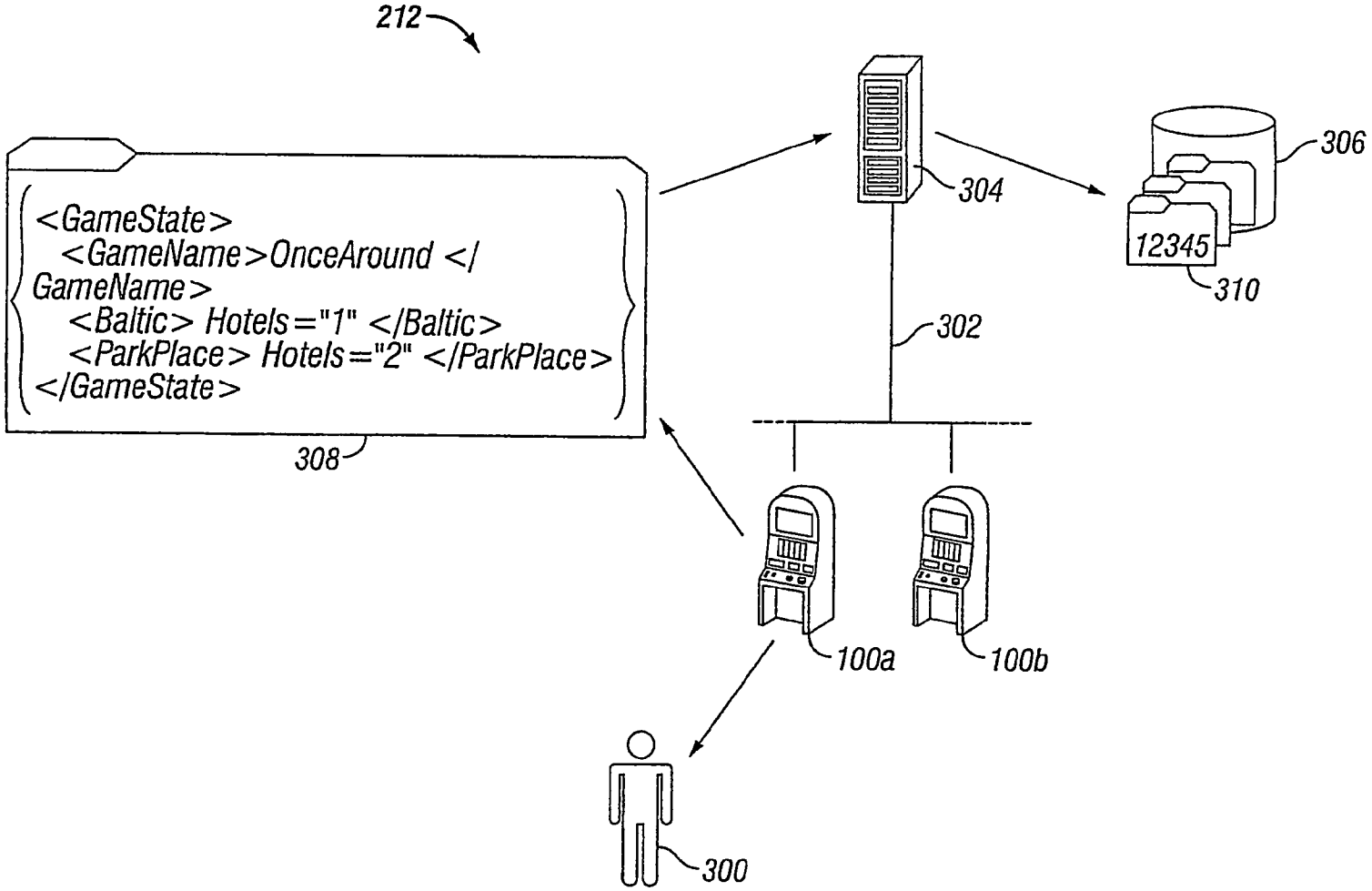
FIG. 3 illustrates a network to which the wagering game terminal of FIG. 1 may be connected.

As alluded to above, the wagering game terminal 100 may be a stand-alone terminal, or it may be part of a network 212 that connects multiple wagering game terminals 100 together. FIG. 3 illustrates the network 212 in more detail, including a plurality of wagering game terminals 100*a* and 100*b* connected via an Ethernet-TCP/IP connection 302 to a network server 304. The wagering game terminals 100*a* and 100*b* are similar to the wagering game terminal 100 (FIG. 1) in that they have many of the same features and components. In addition, one or more functions of the CPU 200 (FIG. 2) in the terminals 100*a* and 100*b* may reside on the network server 304 instead of, or in addition to, the wagering game terminal 100. The network server 304 may then conduct the basic and/or bonus games (or portions thereof) in place of the CPU 200 for each of the wagering game terminals 100*a* and 100*b* connected to the network 212, including providing the input data and information needed to operate the basic and/or bonus games.

The network server 304 may also control the progressive jackpots mentioned previously that are contributed to by all or some of the wagering game terminals 100*a* and 100*b* in the network 212 (e.g., terminal-level jackpots that only each terminal 100*a* or 100*b* contributes to, bank-level jackpots that are contributed to by all of the terminals 100*a* and 100*b* in a particular bank, and wide-area jackpots that are contributed to by a larger number of terminals 100*a* and 100*b*, such as multiple banks).

In addition, in accordance with embodiments of the invention, the network 212 allows players playing at one of the wagering game terminals 100*a* or 100*b* to store game assets that they may have accumulated for subsequent retrieval at a later time. The game assets may be any aspect of a basic and/or bonus game, whether tangible or intangible, that a player may win or accumulate, including, but not limited to, monetary or non-monetary awards, features or characteristics of a game (e.g., a wild symbol, free spins, etc.), features or characteristics of a player (e.g., extra lives, strength, skills, intelligence, equipment, etc.), a bonus game, and the like. By allowing the players to retain their game assets when they depart, the players are given much incentive to return to the wagering game terminals 100*a* and 100*b* at a later time.

Along with game assets, game selection information may also be stored, including any paths the player may have taken and/or options the player may have chosen. The game selection information may then be retrieved and restored to the player in a subsequent game in much the same way as the game asset information. In some embodiments, the game selection information is saved and restored on an individual character or avatar basis. Thus, where two episodes of the same game are played with two different avatars, each avatar will have its own recollection of the game selections. This reflects the idea that the characters or avatars used during each game learn only from the experiences of their particular games. The wagering game terminal 100*a* and 100*b* may then use the game selection information (via the characters or avatars) to guide the players through a subsequent session of the game so that they do not unknowingly repeat unwanted selections.

In some embodiments, the game asset and game selection information may be retained through a "ticket-in-ticket-out" (TITO) system on the network 212. The TITO system issues each player a ticket when the player departs a wagering game terminal 100*a* or 100*b*, which ticket can be used later to retrieve all the assets that the player has accumulated in the current game. Then, when the player returns to any wagering game terminal 100*a* or 100*b* on the network 212, he may retrieve his game asset and game selection information by presenting the ticket. An exemplary implementation of a TITO system is described below.

Referring still to FIG. 3, when a player 300 is ready to cash out of any wagering game terminal 100*a* or 100*b* on the network 212, the player 300 may request a ticket for his current game. Upon receiving such a request, the wagering game terminal 100*a* or 100*b* terminates the game and generates a game-specific file 308 in which it stores various information about game. For example, the game-specific file 308 may identify the wagering game terminal used, game played, game assets accumulated, game selections, and other similar information. The game-specific file 308, which may be a text file, XML file, or other suitable format, is then forwarded over the Ethernet-TCP/IP connection 302 to the server 304. The server 304 thereafter creates a game record 310 for the game-specific file 308 in a database 306 connected to, or residing within, the server 304 and generates a unique identifier for the game record 310. The unique identifier preferably is independent of the player's identification such that the player may remain anonymous to the network 212 and the wagering game terminal 100*a* or 100*b*, but it is also possible to use an identity-based identifier. The server 304 then sends the unique identifier back to the wagering game terminal 100*a* or 100*b*. The wagering game terminal 100*a* or 100*b* subsequently issues the player 300 a ticket, which may be a paper ticket (e.g., barcode) or an electronic ticket (e.g., magnetic), containing the unique identifier. For paper tickets, the ticket may be issued through the information reader 110 or any other suitable means commonly used for issuing such tickets.

When the player 300 returns to one of the wagering game terminals 100*a* or 10*b*, he may present his ticket to the information reader 110 to retrieve his accumulated asset and game selection information. The wagering game terminal 100*a* or 100*b* may be any wagering game terminal on the network 212 and does not have to be the same wagering game terminal that the player 300 played on previously or even a wagering game terminal in the same casino. Upon receiving the ticket, the wagering game terminal 100*a* or 100*b* sends a request to the server 304 to retrieve the game record 310 that corresponds to the unique identifier of the ticket presented. If the server 304 determines that the ticket is valid (i.e., the unique identifier matches an unclaimed game record 310), it retrieves the corresponding game record 310 and sends the information contained therein back to the wagering game terminal 100*a* or 10*b*. The server 304 thereafter either deletes the game record 310 or marks it as "claimed" so that it is not reused. The terminal 100*a* or 100*b* then configures itself according to the game asset and game selection information received from the server 304.

In embodiments where the wagering game terminal 100*a* or 100*b* is a stand-alone terminal that is not connected to the network, the game record 310 may be created by the CPU 200 (FIG. 2) and stored in the local memory 202 of the wagering game terminal instead of on the network 212. Then, when the player 300 returns to the same stand-alone wagering game terminal to present his ticket (e.g., via the information reader 110), the appropriate game record 310 may be retrieved based on the unique identifier on the ticket. The CPU 200 thereafter restores the player's game asset and game selection information along with any other information (e.g., wagering game terminal, game, etc.) that was stored in the game record 310. This allows the player to retain the benefit of his earlier efforts, thereby increasing the player's interest and commitment to a game.

In some embodiments, instead of a ticket, the information reader 110 may include a card reader, and the unique identifier provided by the wagering game terminal 100*a* or 100*b* may be stored on a player's personal identification card. It is also possible to store the entire game-specific file 308 on the player's personal identification card instead of just the unique identifier. Or, the wagering game terminal 100*a* or 100*b* may include a radio frequency identification device (RPID) transceiver or receiver (not shown) such that an RFID transponder held by the player can be used to provide the unique identifier at the wagering game terminal 100*a* or 100*b* without the need to insert a card into the information reader 110. RPID components can be those available from Pacific Northwest National Laboratory (under the United States Department of Energy) of Richland, Wash.

In other embodiments, the information reader 110 may also include a biometric reader, such as a finger, hand, or retina scanner, and the unique identifier may be the scanned biometric information. Additional information regarding biometric scanning, such as fingerprint scanning or hand geometry scanning, is available from International Biometric Group LLC of New York, N.Y. Other biometric identification techniques can be used as well for providing a unique identifier of the player. For example, a microphone can be used in a biometric identification device on the wagering game terminal so that the player can be recognized using a voice recognition system.

An exemplary game played on the wagering game terminal 100*a* or 100*b* will now be described with respect to FIGS. 4-9. The game described here is an adventure-type bonus game similar to the bonus game described previously, except that the characters or avatars have the ability to learn from previous sessions of the game. The knowledge of the characters or avatars may then be used to help the player accomplish the goal of the game. Although a bonus game is described, the teachings and principles applied herein are not limited to bonus games, but may also be applied to basic games as well as other types of games. For example, in the basic game where an outcome is randomly selected from a plurality of outcomes, the characters or avatars may use their knowledge of previous game selections to provide the players with certain hints or strategies that may affect the outcome of the game in a positive manner for the player.

Figure 4:
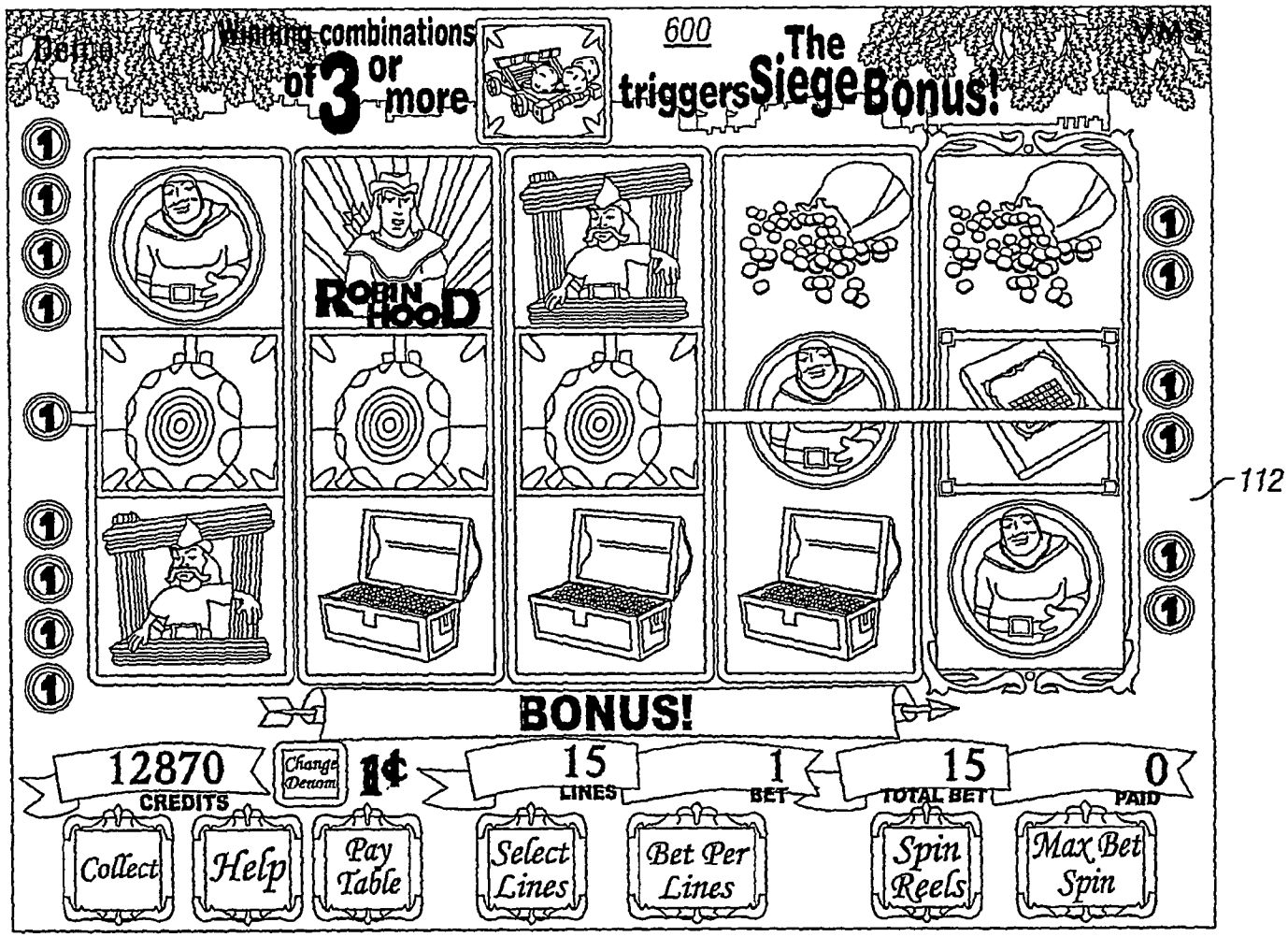
FIG. 4 illustrates a randomly selected outcome resulting an exemplary bonus game that may be played on the wagering game terminal according to one embodiment of the present invention.
Figure 5:
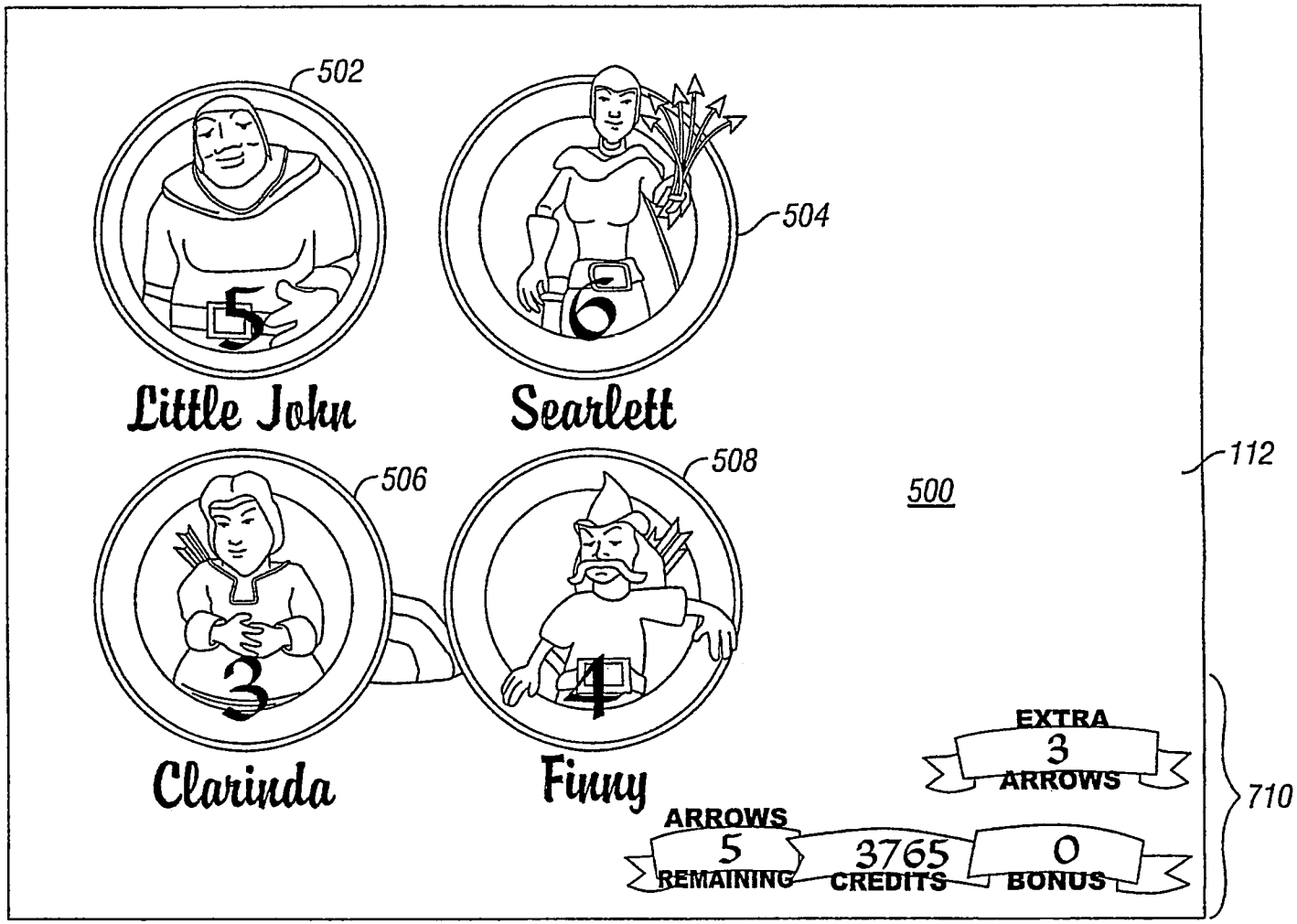
FIG. 5 illustrates an avatar selection screen that may be displayed in the exemplary bonus game of FIG. 4.

FIG. 4 illustrates a close-up view of a basic game (e.g., video slots) from which the bonus game may be awarded. In this example, the basic game has resulted in an outcome, namely, three target symbols in a row, that triggers the bonus game. Other outcomes randomly selected from a plurality of outcomes may also trigger the bonus game without departing from the scope of the invention. The player is then presented in FIG. 5 with an avatar selection screen 500, where he may select one of several available avatars 502, 504, 506, and 508. In this example, the player has selected the first avatar 502, called Little John.

Figure 6:
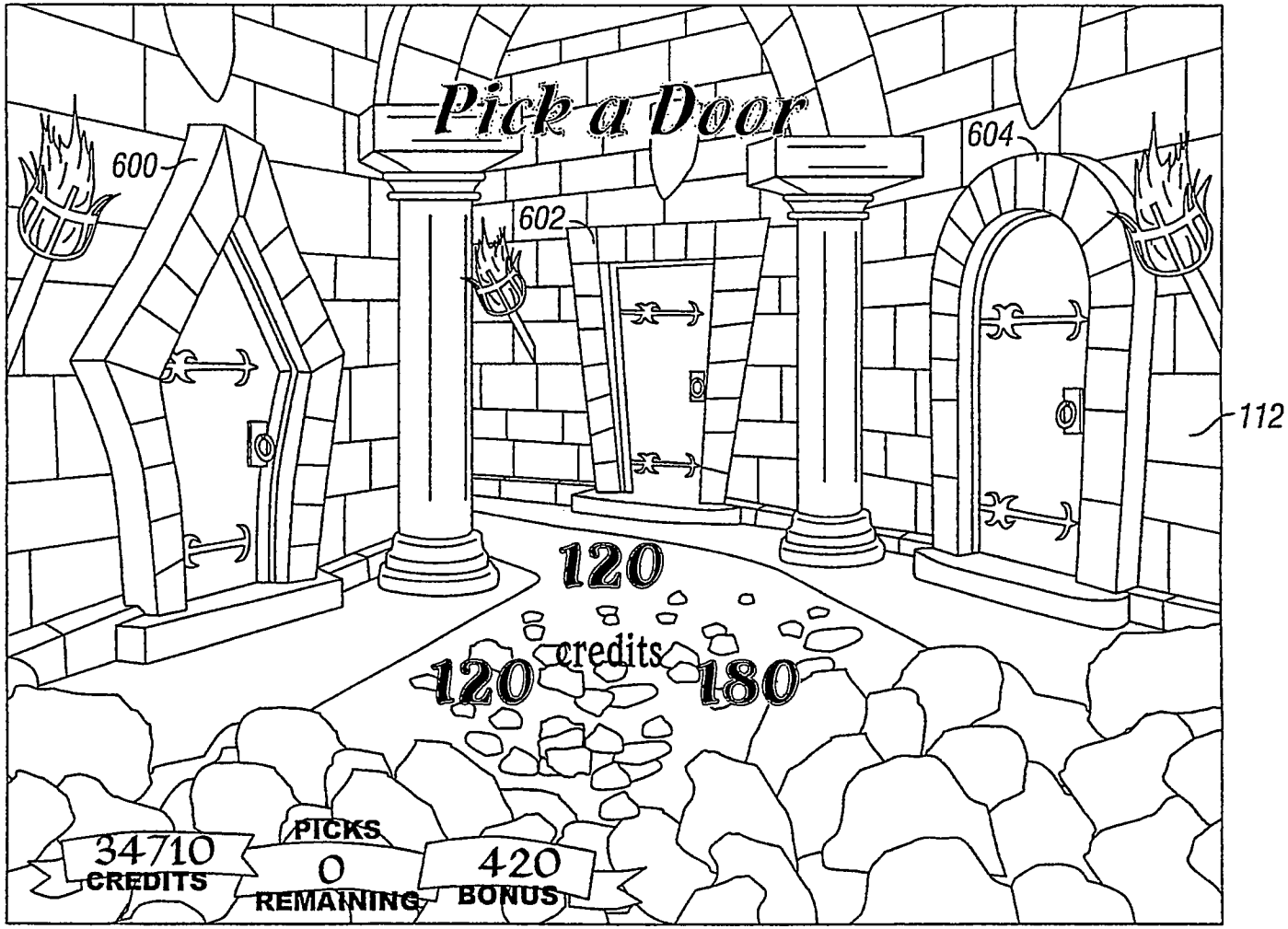
FIG. 6 illustrates a plurality of choices from which the player may make a selection according to one embodiment of the present invention.
Figure 7:
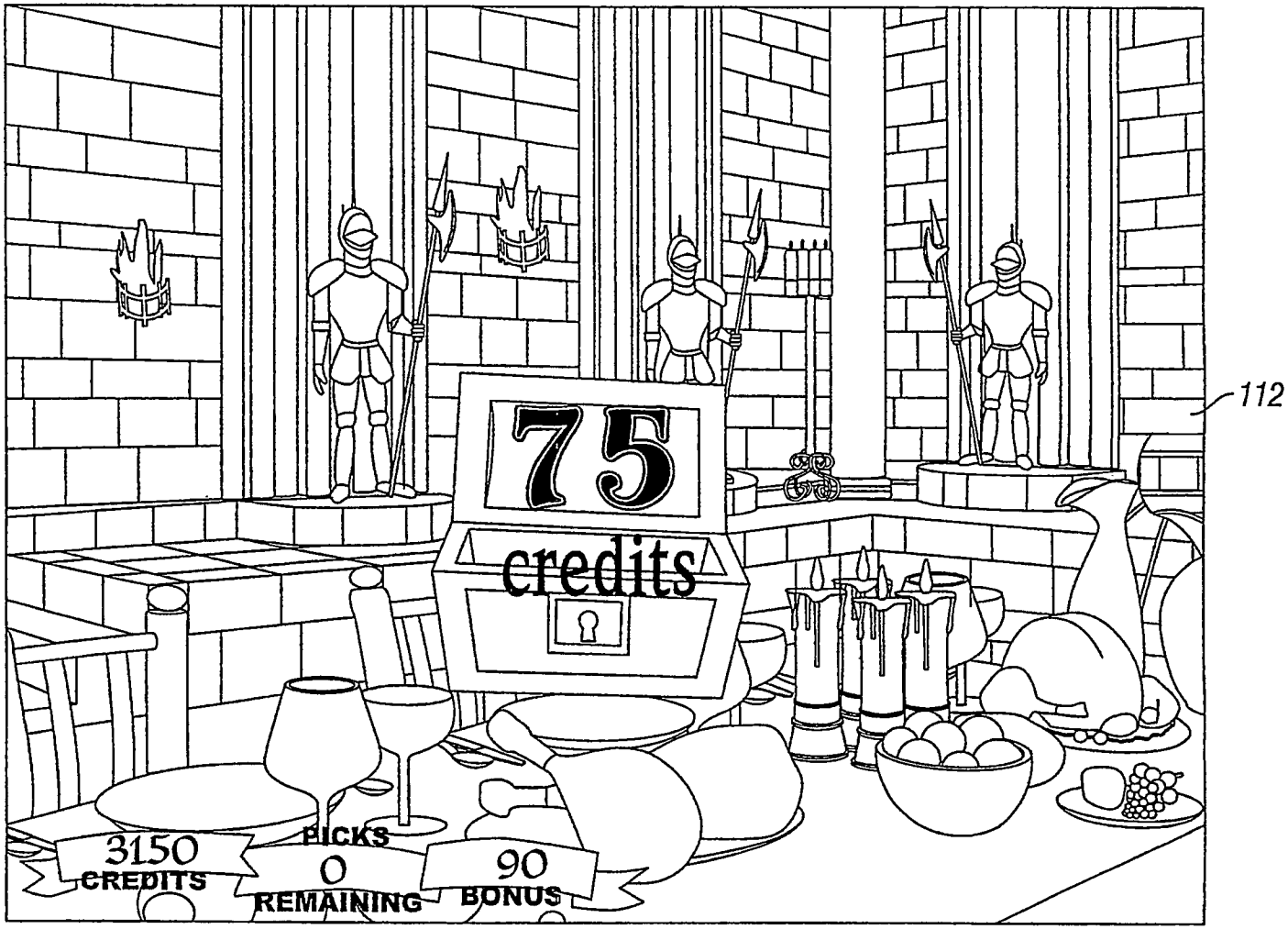
FIG. 7 illustrates an exemplary game asset that the player may awarded upon selecting one of the choices shown in FIG. 6.

Using the Little John avatar 502, the player plays the bonus game until he comes to a screen, shown in FIG. 6, where he is presented with a plurality of doors 600, 602, and 604. Behind one of the doors 600, 602, and 604 lies a grand prize, while the remaining doors have lesser prizes or no prizes. The player is then prompted to select one of the doors 600, 602, and 604. If this is the first time the player is playing this bonus game (or this portion of the bonus game) with the Little John avatar 502, the avatar will not be able to offer any help, since he has not yet "learned" from the game selections. As a result, the player may select the wrong door the first time around. This is illustrated in FIG. 7, where the player has selected the middle door 602, behind which lies a prize of 75 credits, but not the grand prize. The player is then awarded the 75 credits and the bonus game is terminated.

At some point, the player decides to stop playing and requests a ticket. In accordance with embodiments of the invention, the wagering game terminal 100*a* or 100*b* terminates any game still in progress and stores the various game selections made by the player during the gaming session, along with any game assets he has accumulated, and issues a ticket therefor. The player may then use the ticket to restore his game selection information and game assets in a subsequent gaming session in the manner described above (FIG. 3).

Figure 8:
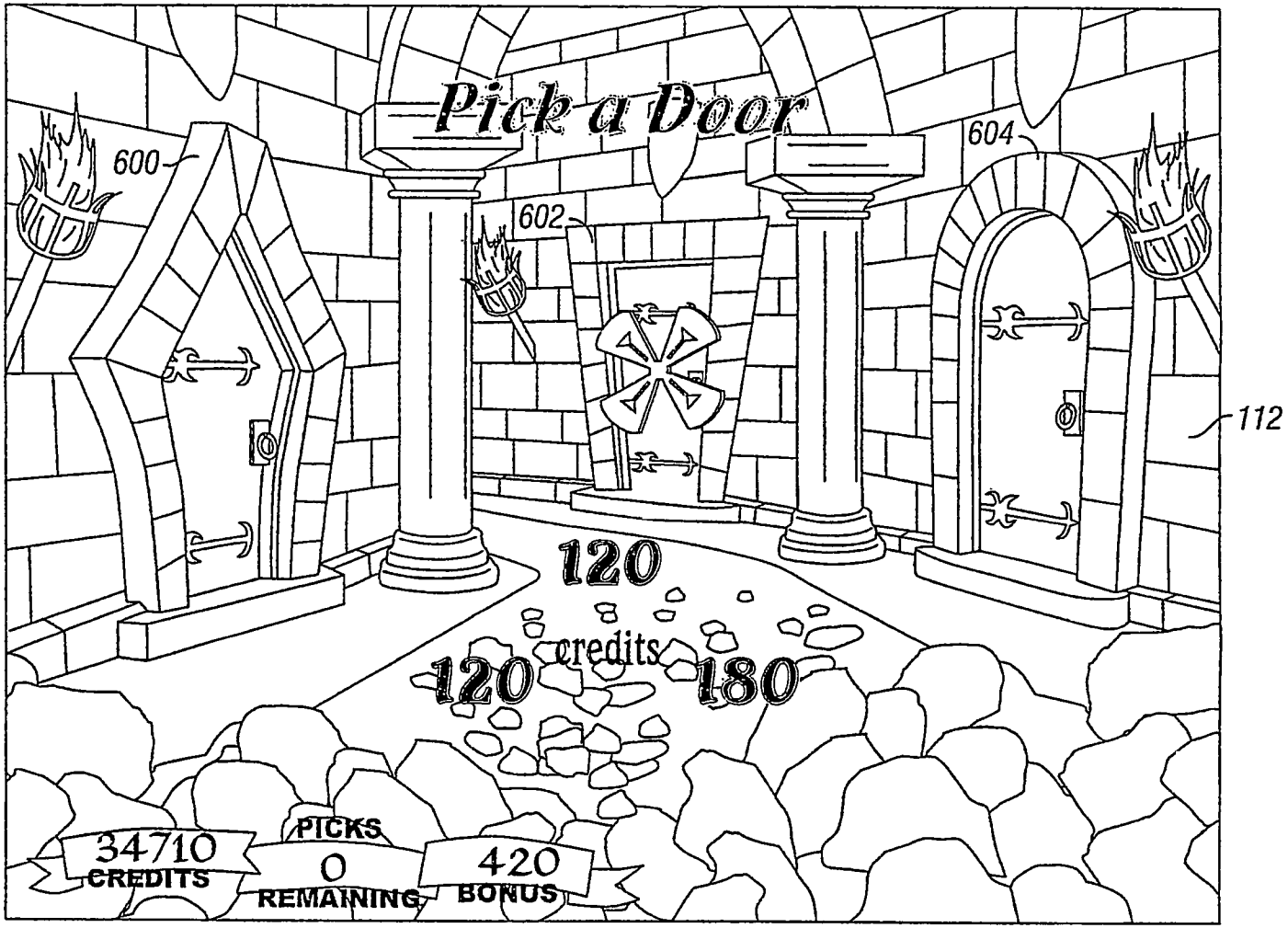
FIG. 8 illustrates a plurality of choices from which the player may make a selection in a subsequent gaming session according to one embodiment of the present invention.
Figure 9:
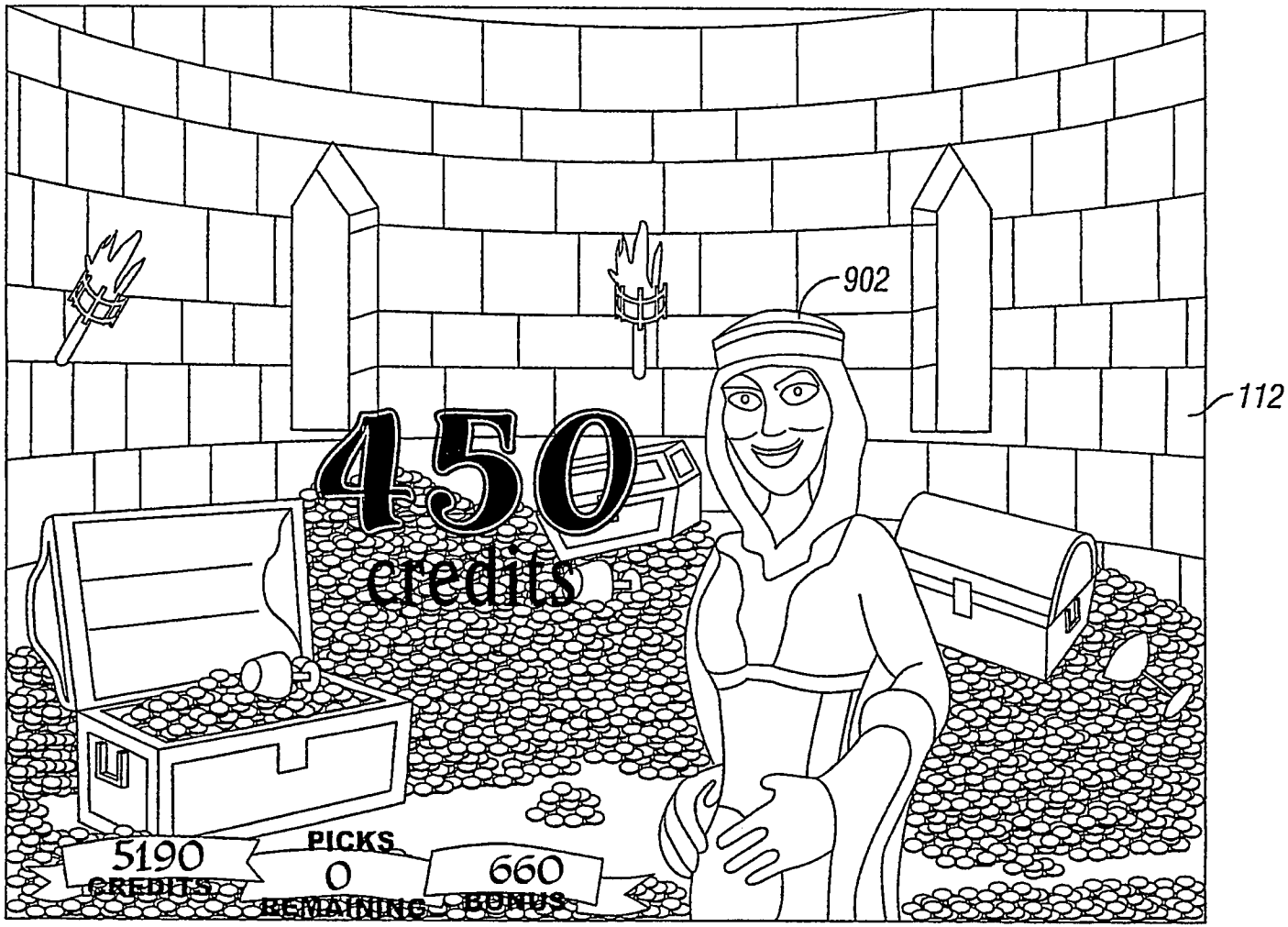
FIG. 9 illustrates a grand prize that the player may win upon making the correct selection according to one embodiment of the present invention.

The restoration of the game selection information is reflected in FIG. 8, where sometime later the player is given another opportunity to play the same bonus game and has again selected the Little John avatar (i.e., avatar 502). However, unlike the previous gaming session (FIG. 6), the Little John avatar has "learned" from the player's earlier selections that the middle door 602 is the wrong door and can therefore guide the player accordingly. In this example, the avatar causes a big "X" to be placed on the middle door 602 to tell the player that that door is the wrong door. The guidance eliminates one of the doors and thus increases the probability that the player will pick the correct door from the remaining doors 600 and 604. This is shown in FIG. 9, where the player has picked the correct door 600 this time, leading to the grand prize, as indicated by the presence of Maid Marian 902.

Other ways of guiding the player besides marking previously selected options may be used without departing from the scope of the invention. For example, audible beeps and text-based messages may also be used, or a combination of markings and/or audible beeps and/or text-based messages, and so on. Or, the previously selected options may simply be removed from the game or otherwise locked so that player is unable to select the option. The avatar may also appear on the main display and verbally remind the player that he has already selected a particular option.

Additionally, it is not always necessary for the player to use the same avatar in order to benefit from earlier game selections. For example, in some implementations, the player may use any available avatar and the wagering game terminal 100*a* or 100*b* may simply apply the most recently stored game selections to that avatar. In implementations that are avatar-specific, however, the player will need to select the same avatar that was used previously in order to benefit from his earlier game selections. And while the player may use multiple avatars, each avatar may be able to retain the game selection information for only a limited amount of time (e.g., three gaming sessions), after which the knowledge will be reset. Alternatively, the avatar may retain the game selection information until the goal of the game is achieved, for example, when the grand prize is won. Where the game does not have a definite goal, but simply keeps evolving and progressing, it is possible for the avatar to retain the game selection indefinitely. Regardless of the specific implementation, the player will be able to benefit from his earlier experiences, thereby reducing player frustration and increasing player excitement and enjoyment. Further, by guiding players through the games, fewer players will be strapped with an extremely long streak of "bad luck" and player winnings on a per gaming session basis will be more likely to approach a certain predetermined average.

Although a game involving an adventure has been described, the principles and teachings of the invention may certainly be used in other types of games. For example, another game where players may benefit from their previous selections is a game called "Party-Pooper" (not shown). In this game, an array of presents is displayed on the main display of the wagering game terminal from which the players may select presents. The majority of the presents reveal prizes or credits when selected, but a few so-called "pooper" presents terminate the game when picked. The idea is for the players to try and pick as many presents as possible without picking a "pooper" present. In accordance with embodiments of the invention, the location of the "pooper" presents when selected may be stored with the game selection information and then restored to the player in a subsequent gaming session. The player's avatar may then guide the player in a subsequent game by marking the locations of any previously selected "pooper" presents so that the player will not repeat those selections.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A wagering game terminal primarily dedicated to playing at least one casino wagering game, comprising:

an electronic wager input device configured to receive a physical input from a player to initiate the casino wagering game in a current gaming session at said wagering game terminal and transform the input into an electronic data signal, said casino wagering game including an outcome randomly selected from a plurality of possible outcomes, said casino wagering game including an avatar representing a player in said current gaming session;

an electronic display device;

one or more controllers including a random element generator, the random element generator configured to generate one or more random elements, the one or more controllers configured to:

initiate the at least one casino wagering game in response to the electronic data signal from the electronic input device, determine an outcome of the at least one casino wagering game based, at least in part, on the one or more random elements;

direct the electronic display device to display said randomly selected outcome and said avatar, said avatar adapted to present one or more suggestions to aid said player to increase a probability that the player will make a favorable selection of one or more game selections concealing outcomes during said casino wagering game in said current gaming session, the one or more game selections concealing at least one previously revealed outcome in a previous gaming session, using information from at least one outcome revealed from the selection of the one or more game selections during play of said casino wagering game in said previous gaming session, said previous gaming session having the same selections concealing the same outcomes available to said player as said current gaming session and, said previous gaming session including said avatar; and a storage unit storing said avatar upon conclusion of said previous gaming session, including information regarding said game selections made using said avatar during said previous gaming session, such that said stored avatar is restored in said current gaming session.

2. The wagering game terminal according to claim 1, wherein said wagering game terminal is further configured to indicate in said current gaming session which game selections were previously made using said stored avatar.

3. The wagering game terminal according to claim 2, wherein said wagering game terminal indicates which game selections were previously made by providing visible markings.

4. The wagering game terminal according to claim 2, wherein said wagering game terminal indicates which game selections were previously made by sounding audible beeps.

5. The wagering game terminal according to claim 2, wherein said wagering game terminal indicates which game selections were previously made by presenting text-based messages.

6. The wagering game terminal according to claim 1, wherein said current gaming session includes a basic game and said game selections are made in said basic game and affect said randomly selected outcome.

7. The wagering game terminal according to claim 1, wherein said current gaming session includes a bonus game and said game selections are made in said bonus game and affect an outcome of said bonus game.

8. The wagering game terminal according to claim 1, wherein said current gaming session is delayed in time following said previous gaming session.

9. The wagering game terminal according to claim 1, wherein said avatar stored from said previous gaming session is the same as said avatar restored in said current gaming session.

10. The wagering game terminal according to claim 1, wherein said avatar stored from said previous gaming session is different from said avatar restored in said current gaming session.

11. A method of operating a, a gaming system primarily dedicated to playing at least one casino wagering game, the gaming system including a random element generator, one or more controllers, an electronic display device, and an electronic input device, the method comprising:

generating one or more random elements with the random element generator;

receiving, via a physical input to the electronic input device, a wager input to initiate the casino wagering game in which an outcome is randomly selected from a plurality of possible outcomes based, at least in part, one the one or more random elements, said at least one casino wagering game including an avatar representing a player in said current gaming session;

restoring a stored avatar having suggestions using information from at least one concealed outcome revealed from the selection of one or more of a plurality of selections during play of said at least one casino wagering game during a previous gaming session via the one or more controllers;

displaying the same plurality of selections concealing outcomes from said previous gaming session and said avatar on the electronic display device, said same plurality of selectable elements concealing said at least one previously revealed outcome in said previous gaming session said avatar presenting one or more suggestions based on said information from said at least one outcome revealed from the selection of the one or more of the plurality of selections during play of said at least one casino wagering game in said previous gaming session, said suggestions providing guidance to a player for increasing a probability that the player will make a favorable selection from the plurality of selections;

receiving, via another input device, one or more game selections during said at least one casino wagering game in said current gaming session; and using at least one of the controllers to store said avatar in a storage unit upon conclusion of said current gaming session, including additional information regarding said game selections made using said avatar during said current gaming session.

12. The method according to claim 11, further comprising allowing said player to select an avatar for both said current gaming session and said previous gaming session.

13. The method according to claim 12, wherein said player selects a single avatar for both said current gaming session and said previous gaming session, further comprising transferring information regarding one or more game selections from said avatar in said previous gaming session to said avatar in said current gaming session.

14. The method according to claim 12, wherein said player selects different avatars for said current gaming session and said previous gaming session, further comprising transferring information regarding one or more game selections from an avatar in said previous gaming session to an avatar in said current gaming session.

15. The method according to claim 11, further comprising reminding said player of which game selections were previously made using said stored avatar.

16. The method according to claim 11, wherein said current gaming session includes a bonus game and said game selections are made in said bonus game and affect an outcome of said bonus game.

17. A wagering game system primarily directed to playing at least one casino wagering game, comprising:

a network server; and a wagering game terminal connected to said network server, the wagering game terminal including:

an electronic display device disposed on the wagering game terminal;

an electronic input device disposed on the wagering game terminal, the electronic input device configured to receive a physical input from a player to initiate the at least one casino wagering game and transform the input into an electronic data signal;

a random element generator configured to generate one or more random elements; and one or more controllers configured to:

initiate the at least one casino wagering game in response to the electronic data signal from the electronic input device, operate the at least one casino wagering game in a current gaming session in which an outcome is randomly selected from a plurality of possible outcomes, said plurality of possible outcomes including at least one special event outcome that results in a special event game including an avatar representing a player and in which said player may chose an option from a plurality of options concealing outcomes, said plurality of options concealing at least one previously revealed outcome in a previous gaming session, displaying one or more suggestions on the electronic display device based on the information from at least one outcome revealed from the selection of the one or more options during play of said special event game in said previous gaming session, said previous gaming session including said avatar and having the same options concealing the same outcomes available to said player as said current gaming session and said suggestions providing guidance to said player for increasing a probability that the player will make a favorable selection;

wherein said network server is configured to save said avatar and additional information regarding said options chosen using said avatar upon conclusion of said special event game in said previous gaming session such that said saved avatar and said additional information can be restored in said current special event game.

18. The wagering game system according to claim 17, further comprising a storage unit for storing said avatar and said additional information regarding said game selections made using said avatar along with an identifier for said information.

19. The wagering game system according to claim 18, wherein said storage unit resides on said network server.

20. The wagering game system according to claim 18, wherein said storage unit resides in said wagering game terminal.

21. The wagering game system according to claim 18, wherein said identifier for said information is player identity-independent.

22. The wagering game system according to claim 18, wherein said identifier for said information is based at least in part on a player identification.

23. A method of operating a gaming system primarily dedicated to playing at least one casino wagering game, the gaming system including a plurality of gaming terminals each including a random element generator, one or more controllers, an electronic display device, and an electronic input device, the method comprising:

conducting a first gaming session via a first gaming terminal in the plurality of gaming terminals, the first gaming session including generating one or more random elements with the random element generator of the first gaming terminal, receiving, responsive to a physical input to the electronic input device of the first gaming terminal, a wager input to initiate the at least one casino wagering game, determining, by the one or more controllers of the first gaming terminal, an outcome of the at least one casino wagering game based, at least in part, on the one or more random elements, displaying a wagering game having an avatar and a plurality of selectable elements each concealing an outcome on the electronic display device of the first gaming terminal, receiving one or more selections of the plurality of player selectable elements using the avatar, revealing at least one outcome from the one or more selections of the plurality of player selectable elements in response to the receiving one or more selections on the electronic display device of the first gaming terminal, and storing, in a storage unit, information based on revealing the at least outcome from the one or more selections; and conducting a second gaming session via a second gaming terminal in the plurality of gaming terminals, the second gaming session being subsequent to the first gaming session and including generating one or more random elements with the random element generator of the second gaming terminal, receiving, responsive to a physical input to the electronic input device of the second gaming terminal, a wager input to initiate the at least one casino wagering game, determining, by the one or more controllers of the second gaming terminal, an outcome of the at least one casino wagering game based, at least in part, on the one or more random elements, displaying the at least one casino wagering game having the avatar and the same plurality of selectable elements concealing the same outcomes in the first gaming session, the same plurality of selectable elements concealing the previously revealed outcome in the first gaming session on the electronic display device of the second gaming terminal, presenting, via the avatar, one or more suggestions based on the information stored in the storage unit, the suggestions providing guidance to a player for increasing a probability that the player will make a favorable selection, and after the presenting, receiving one or more selections of the plurality of selectable elements.

24. The method of claim 23, wherein the one or more suggestions are presented visually or audibly.

25. The method of claim 23, wherein the presenting includes marking at least one of the one or more selections from the first gaming session.

* * * * *